US009279609B2

(12) United States Patent
Kim et al.

(10) Patent No.: US 9,279,609 B2
(45) **Date of Patent: *Mar. 8, 2016**

(54) REFRIGERATOR AND METHOD OF MANUFACTURING INNER DOOR THEREOF

(71) Applicant: SAMSUNG ELECTRONICS CO., LTD., Suwon-si, Gyeonggi-do (KR)

(72) Inventors: Byoung Mok Kim, Gwangju (KR); Du Sic Kong, Pyeongtaek-si (KR); Young Jae Song, Gwangju-si (KR); Seung Yong Yang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/072,174

(22) Filed: Nov. 5, 2013

(65) Prior Publication Data

US 2014/0132142 A1 May 15, 2014

(30) Foreign Application Priority Data

Nov. 9, 2012 (KR) ..... 10-2012-0126891

(51) Int. Cl.

| | |
|---|---|
| ***A47B 96/04*** | (2006.01) |
| ***F25D 23/02*** | (2006.01) |
| ***F25D 23/08*** | (2006.01) |

(52) U.S. Cl.

CPC ..... *F25D 23/028* (2013.01); *F25D 23/02* (2013.01); *F25D 23/087* (2013.01); *F25D 2323/021* (2013.01)

(58) Field of Classification Search

USPC ..... 312/401, 405, 405.1; 277/629, 641, 643

See application file for complete search history.

(56) References Cited

U.S. PATENT DOCUMENTS

| | | | | |
|---|---|---|---|---|
| 3,218,111 | A * | 11/1965 | Steiner | 312/405.1 |
| 4,583,796 | A * | 4/1986 | Nakajima et al. | 312/405 |
| 4,617,759 | A * | 10/1986 | Pasqualini et al. | 49/478.1 |
| 4,884,415 | A * | 12/1989 | Mandel et al. | 62/277 |
| 5,966,963 | A * | 10/1999 | Kovalaske | 62/441 |
| 6,227,634 | B1 * | 5/2001 | Cittadini et al. | 312/296 |
| 2011/0023527 | A1 * | 2/2011 | Kwon et al. | 62/441 |
| 2012/0286638 | A1 * | 11/2012 | Lee et al. | 312/405 |

FOREIGN PATENT DOCUMENTS

| | | | |
|---|---|---|---|
| JP | 2011069612 | * | 4/2011 |

* cited by examiner

*Primary Examiner* — Matthew Ing

(74) *Attorney, Agent, or Firm* — Staas & Halsey LLP

(57) ABSTRACT

A refrigerator provided with an inner panel molded through injection molding while an accommodation groove in which an installation member is accommodated is formed at the inner panel, and as a gasket is installed at an installation groove of the installation member, the use of a complex mold such as a slide core is minimized while making it easy to install the gasket at the inner panel.

19 Claims, 15 Drawing Sheets

REFRIGERATOR AND METHOD OF MANUFACTURING INNER DOOR THEREOF

CROSS-REFERENCE TO RELATED APPLICATIONS

This application claims the benefit of the Korean Patent Application No. 10-2012-0126891, filed on Nov. 9, 2012, in the Korean Intellectual Property Office, the disclosure of which is incorporated herein by reference.

BACKGROUND

1. Field

Embodiments of the present disclosure relate to a refrigerator having an inner door having an opening, door guards provided at the opening, and an outer door configured to open/close the opening.

2. Description of the Related Art

In general, a refrigerator is a household appliance configured to store food in a fresh state for a long time while provided with a storage compartment in which food is stored, and a cool air supplying apparatus configured to supply cool air to the storage compartment.

In the storage compartment, shelves are provided for food to be placed thereon. The storage compartment is provided in a way that a front surface thereof is open so that food may be input/output, and the open front surface of the storage compartment may be open/closed by a main door rotatably coupled to a body of the refrigerator. At a rear surface of the main door, door guards capable of storing food separately from the shelves disposed in the storage compartment may be provided.

The door guards as such are provided at the rear surface of the main door, and thus are generally approachable by opening the main door. Meanwhile, a refrigerator, which is provided with a subsidiary door separately at the main door for the door guards to be approachable without having to open the main door, is present. The refrigerator having the subsidiary door as such, since the door guards provided at the rear surface of a door may be approachable by only opening the subsidiary door, is provided with variable ways of storing food, and also may be provided with the effect of preserving cool air.

However, the subsidiary door as such is limited to the size thereof, and thus only some of the plurality of door guards provided at the rear surface of the main body may be approachable.

SUMMARY

Therefore, it is an aspect of the present disclosure to provide a refrigerator enabling all of the plurality of door guards provided at a main door of the refrigerator by only opening a subsidiary door of the refrigerator without having to open the main door, and a method of manufacturing the same.

Additional aspects of the disclosure will be set forth in part in the description which follows and, in part, will be apparent from the description, or may be learned by practice of the disclosure.

In accordance with an embodiment of the present disclosure, a refrigerator includes a body, a storage compartment, an inner door, a plurality of door guards, and an outer door. The storage compartment may be formed at an inside of the body. The inner door may have an opening corresponding to the storage compartment, and a door frame forming the opening, the inner door rotatably coupled to the body. The plurality of door guards may be provided at the opening. The outer door may be rotatably coupled to the body to open/close the opening. The door frame may include an inner panel, an outer panel, an insulation material disposed in between the inner panel and the outer panel, an installation member coupled to the inner panel, and a gasket installed at the installation member to seal in between the body and the inner panel.

The inner panel may include a pair of inner side walls configured to form the opening and support the door guards. The inner side walls may be formed to be flat from an entry of the opening to an exit of the opening, and a distance between the pair of inner side walls may be constant from the entry of the opening to the exit of the opening.

The inner panel may include an accommodation groove to accommodate the installation member, and a plurality of accommodation protrusions protruding toward an inner side of the accommodation groove to fix the installation member.

The plurality of accommodation protrusions may be formed at a portion of the accommodation groove while being spaced apart from one another.

The inner panel may be injection-molded by use of resin.

The installation member may include insertion grooves into which the accommodation protrusions are inserted.

The installation member may include an installation groove at which the gasket is installed, and installation protrusions protruding toward an inner side of the installation groove to fix the gasket.

The installation protrusions may be successively formed at an entire area of the installation groove lengthwise along the installation member.

The installation member may be extrusion-molded.

The inner panel may include an upper frame, a lower frame, a left frame, and a right frame. The installation member, which are provided in plural, may include a first installation member, a second installation member, a third installation member, and a fourth installation member installed at the upper frame, the lower frame, the left frame, and the right frame, respectively.

The first installation member, the second installation member, the third installation member, and the fourth installation member may be installed while being spaced apart from one another without being connected to one another.

The outer panel may be formed of metal, and the outer door may include a gasket configured to seal in between the inner door and the outer door, and the gasket may include a magnet.

In accordance with another aspect of the present disclosure, a refrigerator includes a body, a storage compartment, an inner door, a gasket assembly, a plurality of door guards, and an outer door. The storage compartment may be formed at an inside the body. The inner door may have an opening corresponding to the storage compartment, an inner panel, an outer panel, and an insulation material disposed in between the inner panel and the outer panel, the inner door rotatably coupled to the body. The gasket assembly may be configured to seal in between the inner door and the body. The plurality of door guards may be provided at the opening. The outer door may be rotatably coupled to the body to open and close the opening. The inner panel may include an accommodation groove formed at a bottom surface of the inner panel so that the gasket assembly is coupled thereto. The gasket assembly may include an installation member accommodated in the accommodation groove, and a gasket installed at the installation member.

The inner panel may include a pair of inner side walls configured to form the opening and support the door guards. The inner side walls may be formed to be flat from an entry of the opening to an exit of the opening, and a distance in between the pair of inner side walls may be constant from the entry of the opening to the exit of the opening.

The inner panel may be injection-molded by use of resin.

In accordance with another aspect of the present disclosure, a method of manufacturing a refrigerator, having a body, a storage compartment formed at an inside of the body, an inner door having an opening corresponding to the storage compartment and rotatably coupled to the body, a plurality of door guards provided at the opening, and an outer door rotatably coupled to the body to open/close the opening includes injection-molding an inner panel having an accommodation groove to accommodate an installation member; inserting the installation member into the accommodation groove; and installing a gasket at the installation member.

The inner panel may include a pair of inner side walls configured to form the opening and support the door guards. The inner side walls may be formed to be flat from an entry of the opening to an exit of the opening, and a distance in between the pair of inner side walls may be constant from the entry of the opening to the exit of the opening.

As described above, in a case of forming an inner door through injection-molding, the use of a complex molding such as a slide core is minimized, and the assembly of a gasket may be enhanced.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
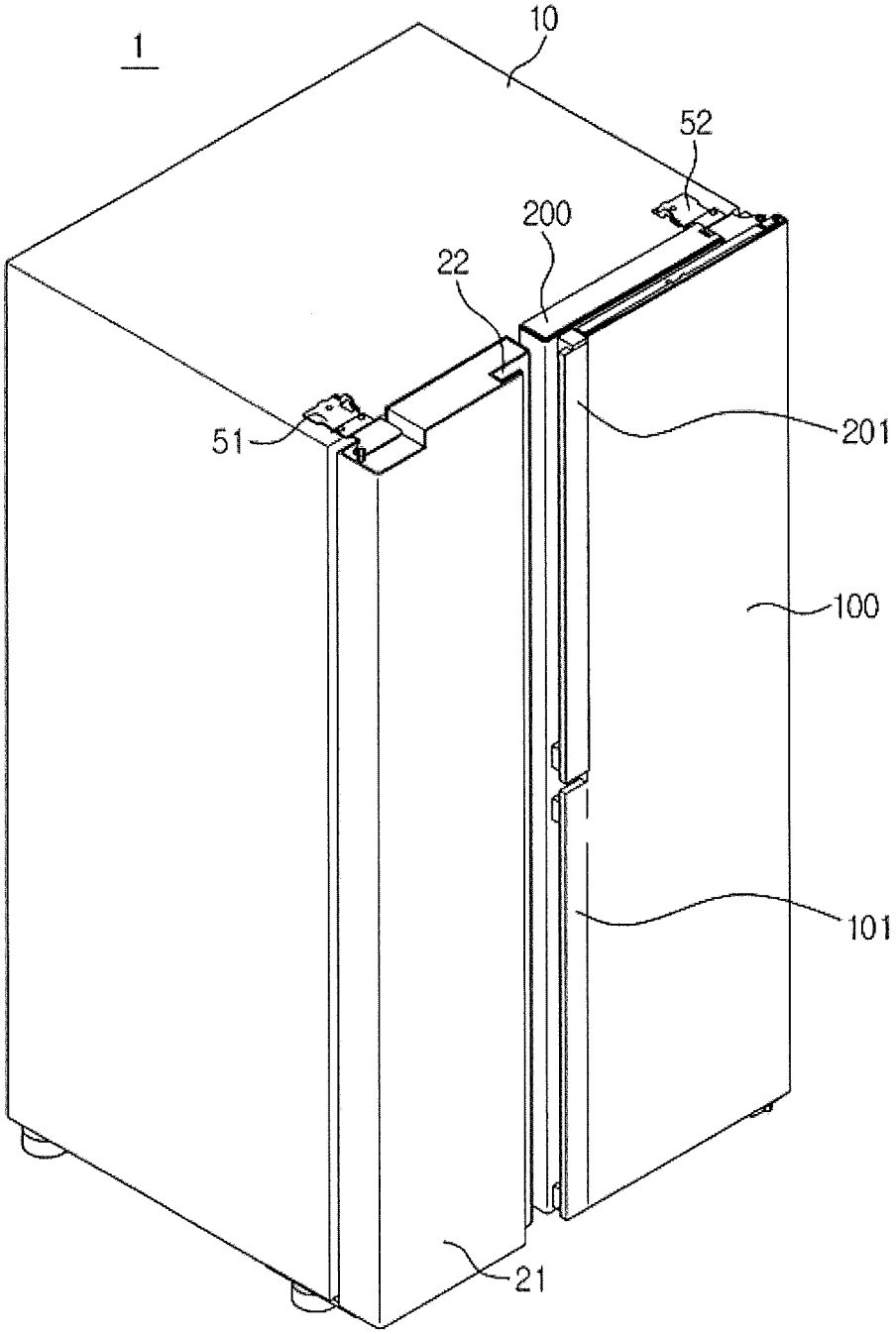
FIG. 1 is a drawing illustrating a refrigerator in accordance with an embodiment of the present disclosure, and illustrating a state of both an inner door and an outer door of the refrigerator are closed.

Reference will now be made in detail to the embodiments of the present disclosure, examples of which are illustrated in the accompanying drawings, wherein like reference numerals refer to like elements throughout.

Figure 2:
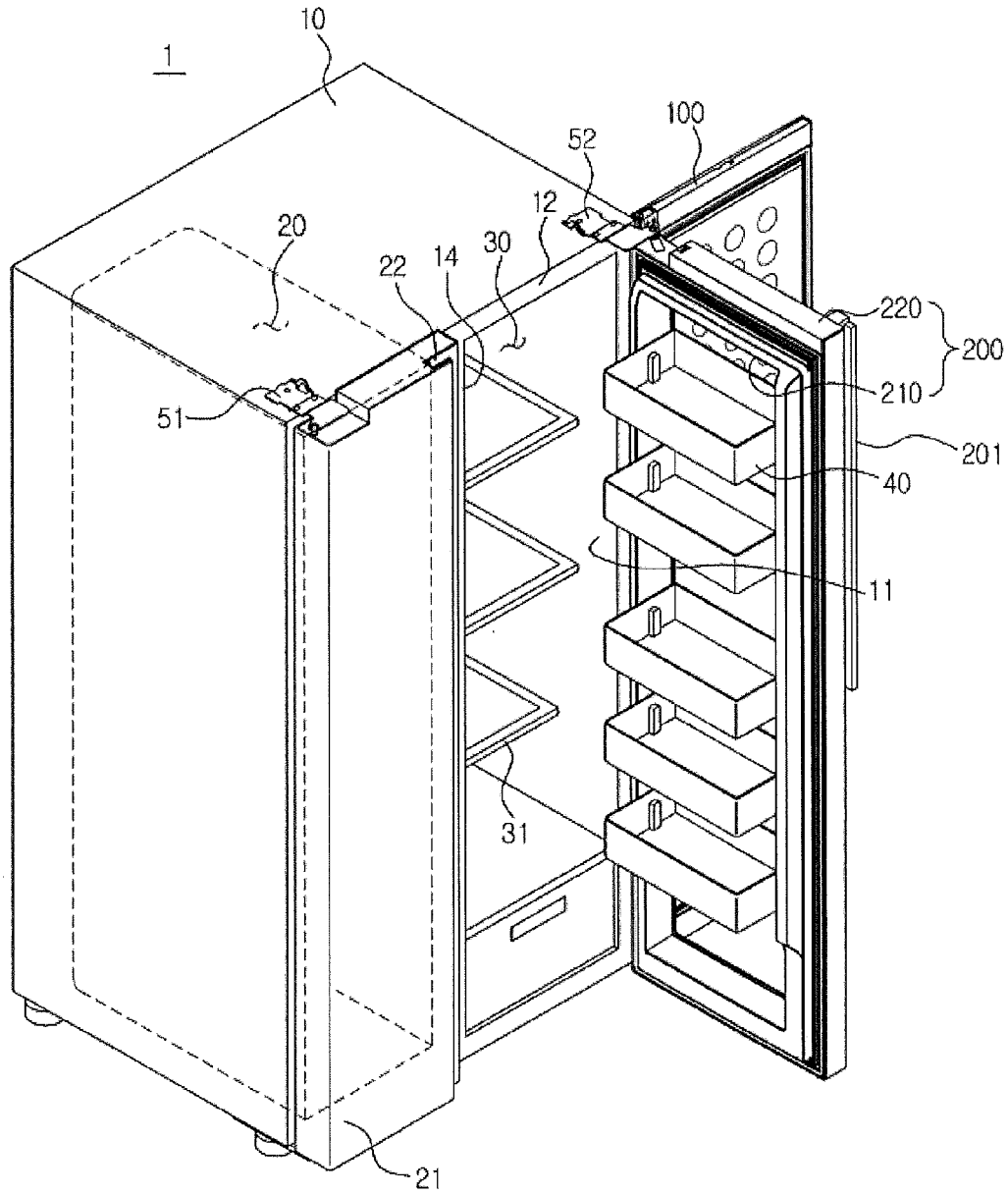
FIG. 2 is a drawing illustrating a state of the inner door and the outer door of the refrigerator of FIG. 1 open separately.
Figure 3:
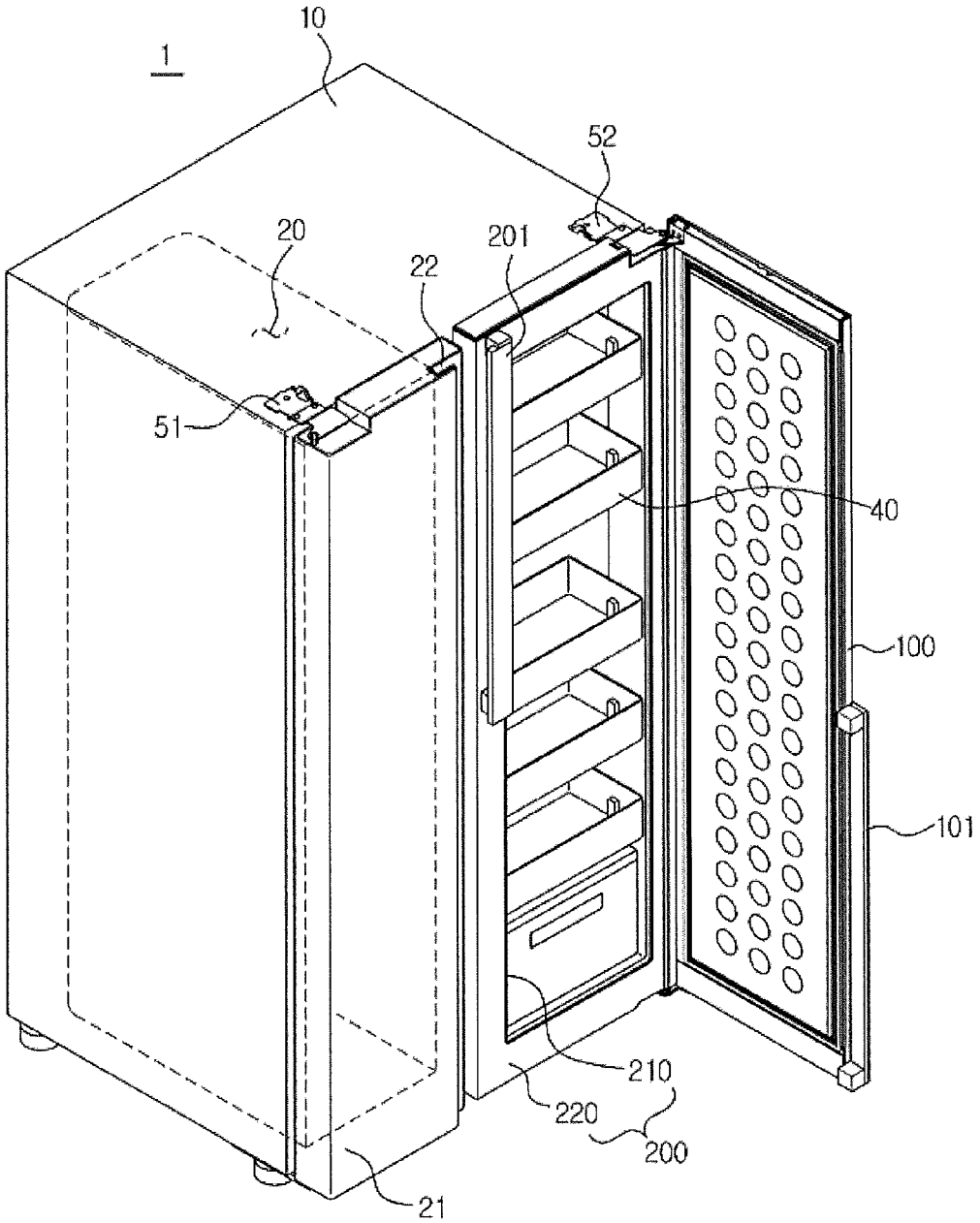
FIG. 3 is a drawing illustrating a state of only the outer door of the refrigerator of FIG. 1 open.
Figure 4:
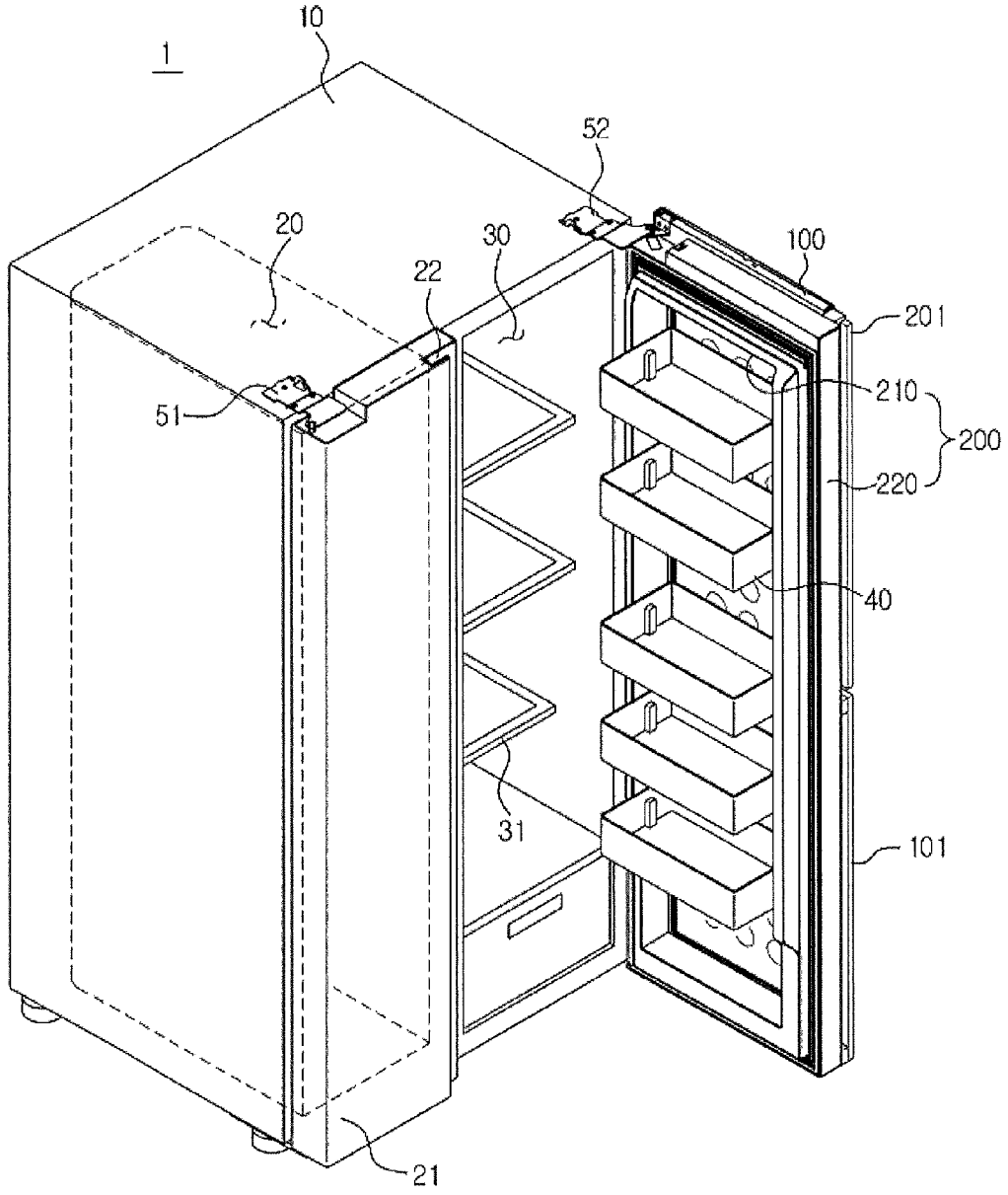
FIG. 4 is a drawing illustrating a state of only the inner door of the refrigerator of FIG. 1 open.

FIG. 1 is a drawing illustrating a refrigerator in accordance with an embodiment of the present disclosure, and illustrating a state of both an inner door and an outer door of the refrigerator are closed, FIG. 2 is a drawing illustrating a state of the inner door and the outer door of the refrigerator of FIG. 1 open separately, FIG. 3 is a drawing illustrating a state of only the outer door of the refrigerator of FIG. 1 open, and FIG. 4 is a drawing illustrating a state of only the inner door of the refrigerator of FIG. 1 open.

Referring to FIGS. 1 to 4, a refrigerator 1 in accordance with an embodiment of the present disclosure includes a body 10, storage compartments 20 and 30 provided at an inside the body 10, and a cool air supplying apparatus to supply cool air to the storage compartments 20 and 30.

The body 10 is formed in an approximately box shape, and includes an inner case 11 forming the storage compartments 20 and 30, an outer case 12 coupled to an outer side of the inner case 11 to form an exterior appearance, and an insulation material provided in between the inner case 11 and the outer case 12. The inner case 11 may be formed of resin, while the outer case 12 may be formed of metal.

The cool air supplying apparatus includes a compressor (not shown), a condenser (not shown), an expansion valve (not shown), and an evaporator (not shown), and is configured to generate cool air by circulating refrigerant and using latent heat of vaporization.

The storage compartments 20 and 30 may be divided by a middle wall 14 into a freezing compartment 20 on the left side and a refrigerating compartment 30 on the right side. However, the positions of the freezing compartment 20 and the refrigerating compartment 30 may be switched with respect to each other. In the refrigerating compartment 30, shelves 31 on which food may be placed are provided.

The freezing compartment 20 and the refrigerating compartment 30 each is provided with an open front surface, so that food may be input/output, and the open front surface of the freezing compartment 20 may be open/closed by a freezing compartment door 21, while the open front surface of the refrigerating compartment 30 may be open/closed by an outer door 100 and an inner door 200.

The freezing compartment door 21 may be rotatably coupled to the body 10 by an upper hinge member 51 and a lower hinge member (not shown). The outer door 100 and the inner door 200 as well may be rotatably coupled to the body 10 by an upper hinge member 52 and a lower hinge member (not shown).

At this time, although not described in detail, the outer door 100 and the inner door 200 each may be provided with a different rotation axis with respect to each other, or may share a single rotation axis.

The freezing compartment door 21, the outer door 100, and the inner door 200 may be provided with a handle 22, a handle 101, and a handle 201, respectively.

Meanwhile, the inner door 200 includes an opening 210 having the size that mostly corresponds to the size of the refrigerating compartment 30, and a door frame 220 forming the opening 210. Thus, the door frame 220 may be provided with an approximate rectangular frame shape.

At the opening 210, a plurality of door guards 40 in which food may be stored are provided. At the each door guard 40, food generally having lower height and smaller size thereof, or food that is needed to be frequently input/output may be stored. The plurality of door guards 40 may be arranged at the opening 210 in line one on top of the other.

The outer door 100 is not provided with an opening, and may be provided with the shape of an approximately flat panel. Thus, the outer door 100 may be able to open/close the opening 210 of the inner door 200.

With respect to the usage motion of the inner door 200 and the outer door 100 having the structure as such in accordance with an embodiment of the present disclosure, as illustrated in FIG. 1, as the inner door 200 and the outer door 100 are closed, the refrigerating compartment 30 is sealed and the cool air of the refrigerating compartment 30 may be preserved.

As illustrated on FIG. 3, when only the outer door 100 is open in a state in which the inner door 200 is closed, a user may approach the plurality of door guards 40 to input/output food. At this time, the release of the cool air of the refrigerating compartment 30 may be restrained when compared to a case in which the inner door 200 is open.

As illustrated in FIG. 4, when the inner door 200 is open, a user may approach the inside the refrigerating compartment 30 to input/output food stored at the shelf 31. At this time, by approaching the plurality of door guards 40, food may be input/output to/from the plurality of door guards 40.

As discussed above, the refrigerator 1 in accordance with an embodiment of the present disclosure is configured to input/output food in various ways according to the needs of a user, and in a case when inputting/outputting food stored at the plurality of door guards 40, only the outer door 100 is needed to be open, and thus the release of the cool air may be minimized.

Furthermore, the door guard 40 of the refrigerator 1 in accordance with an embodiment of the present disclosure is provided with an expanded storage space when compared to the storage space of the door guard of a conventional refrigerator, and thus the storing of food may be achieved in variable ways and the effect of minimizing the release of cool air may be shown in a larger scale.

Hereinafter, the structures of the inner door 200, the outer door 100, and the door guards 40 of the refrigerator 1 in accordance with an embodiment of the present disclosure will be described in detail.

Figure 5:
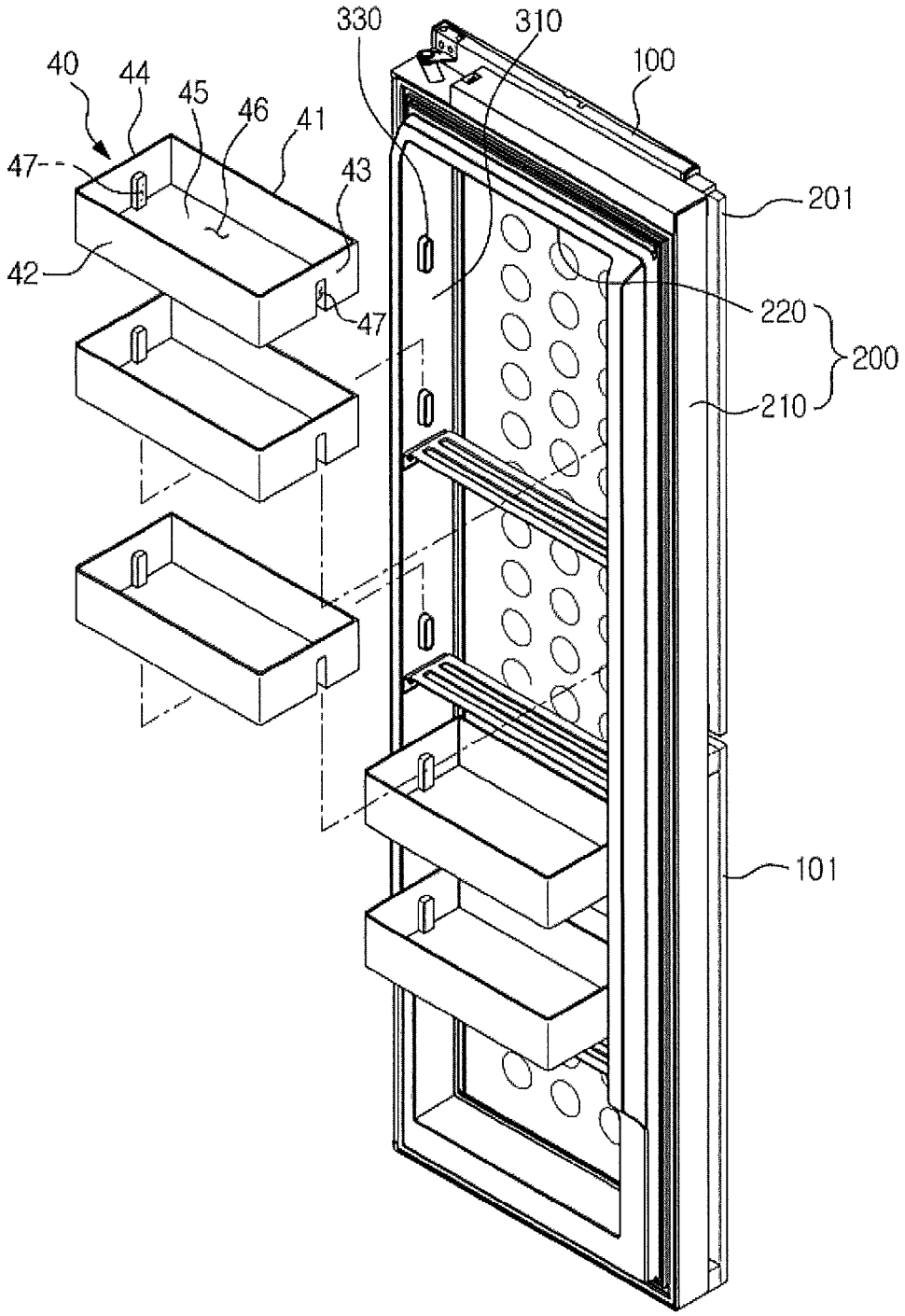
FIG. 5 is a drawing illustrating door guards and the inner door of the refrigerator of FIG. 1.
Figure 6:
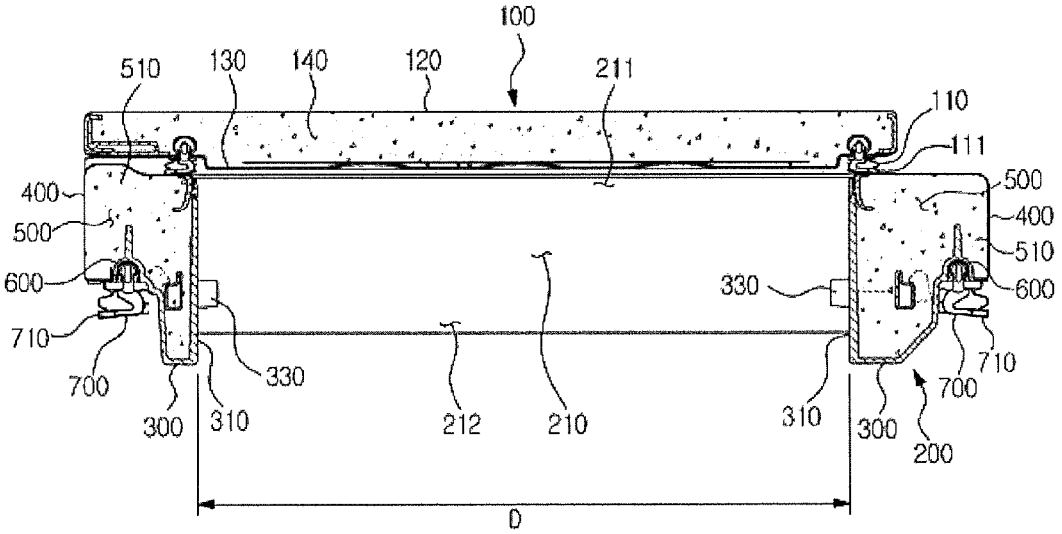
FIG. 6 is a cross-sectional view of the inner door and the outer door of the refrigerator of FIG. 1
Figure 7:
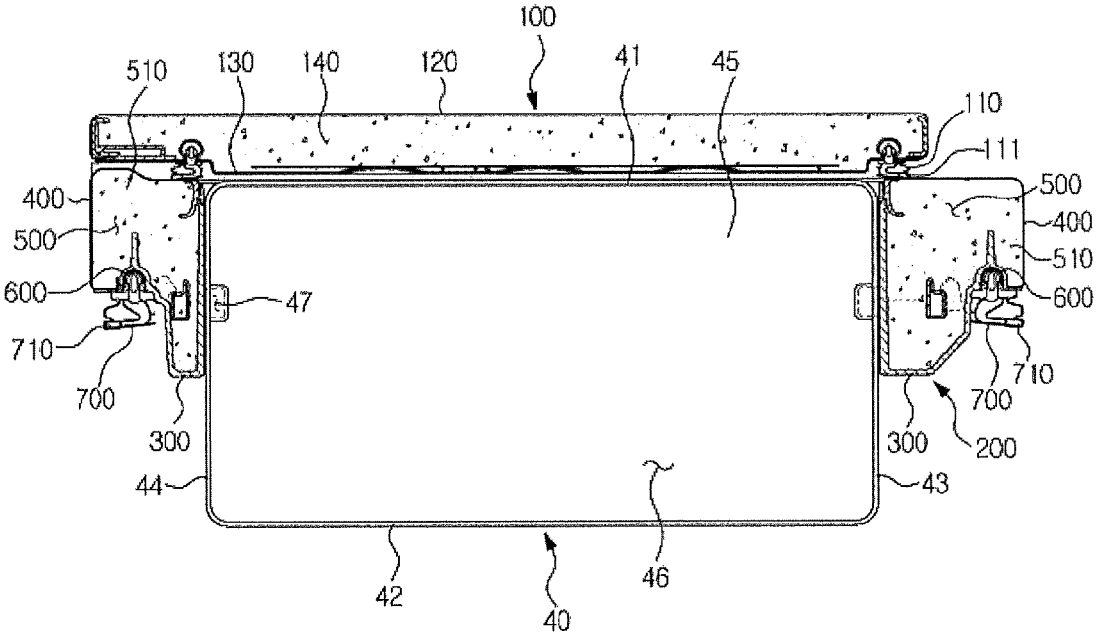
FIG. 7 is a cross-sectional view illustrating a state of the door guards mounted at the inner door of the refrigerator of FIG. 1.
Figure 8:
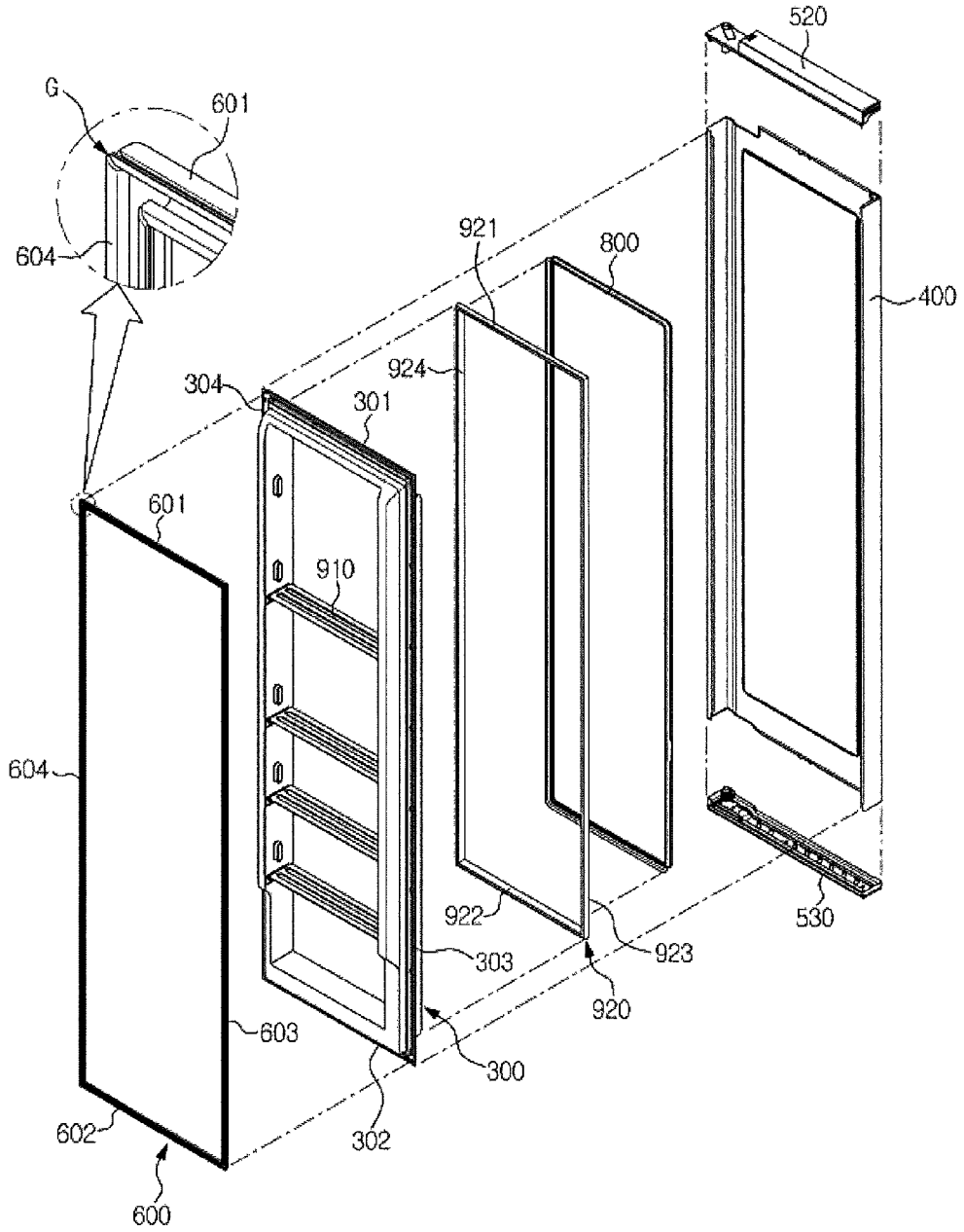
FIG. 8 is an exploded perspective view illustrating an exploded structure of the inner door of the refrigerator of FIG. 1.
Figure 9:
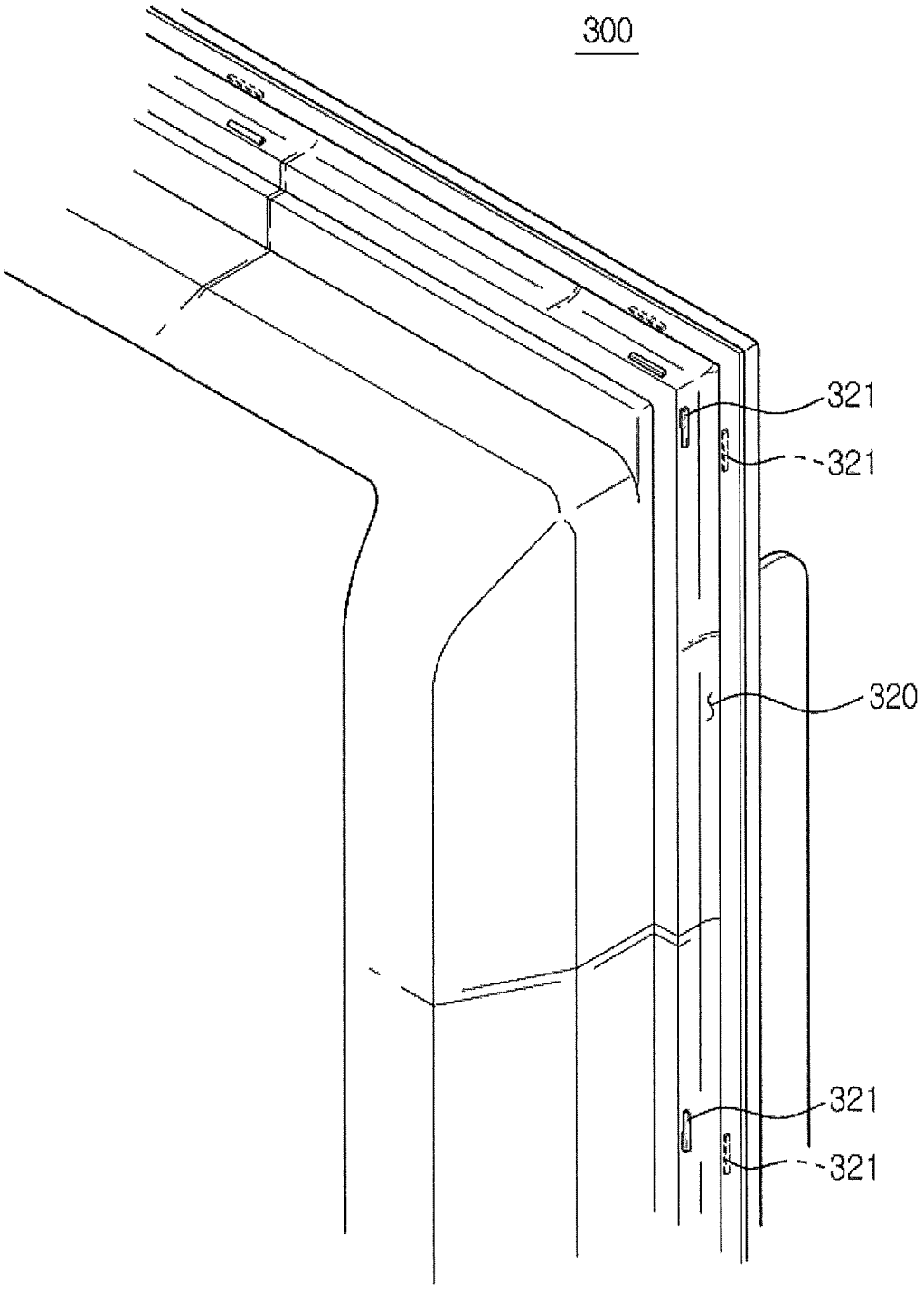
FIG. 9 is a drawing illustrating a portion of an inner panel of the inner door of the refrigerator of FIG. 1.
Figure 10:
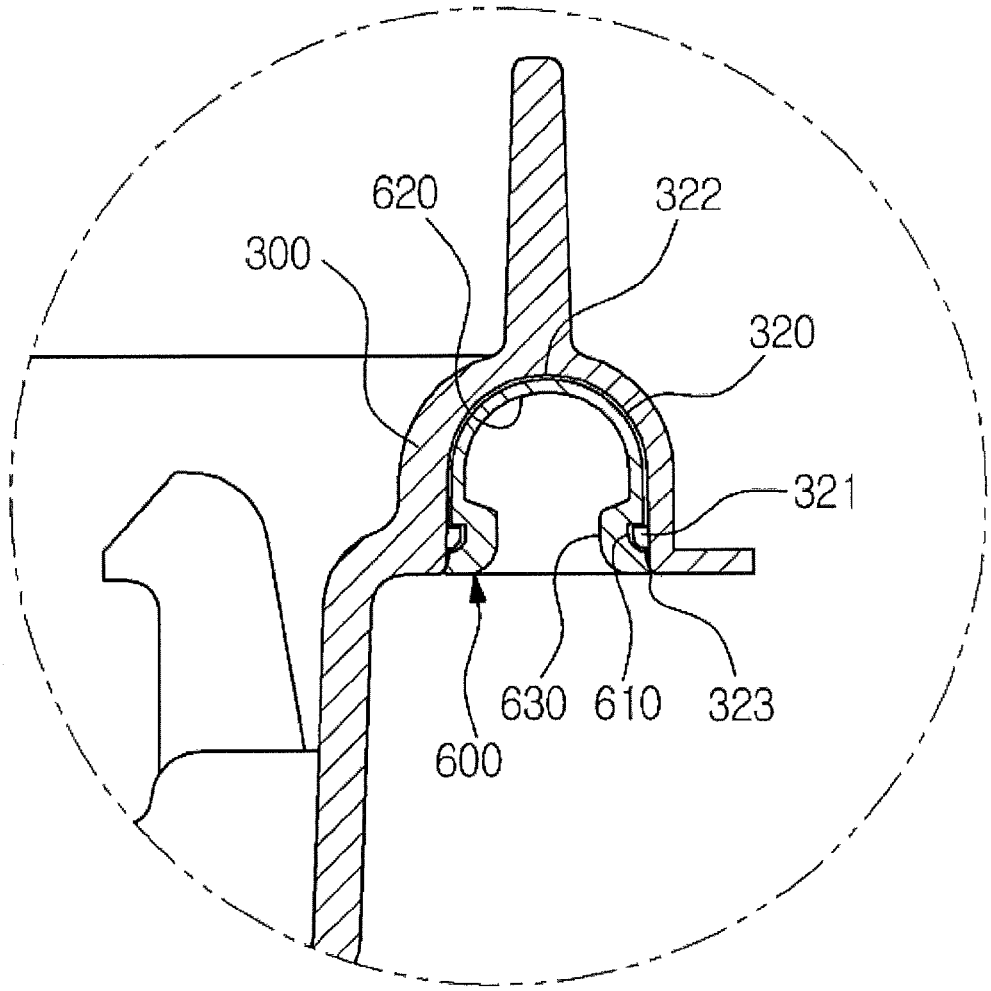
FIG. 10 is a cross-sectional view illustrating a state of an installation member accommodated in the inner panel of the inner door of the refrigerator of FIG. 1.
Figure 11:
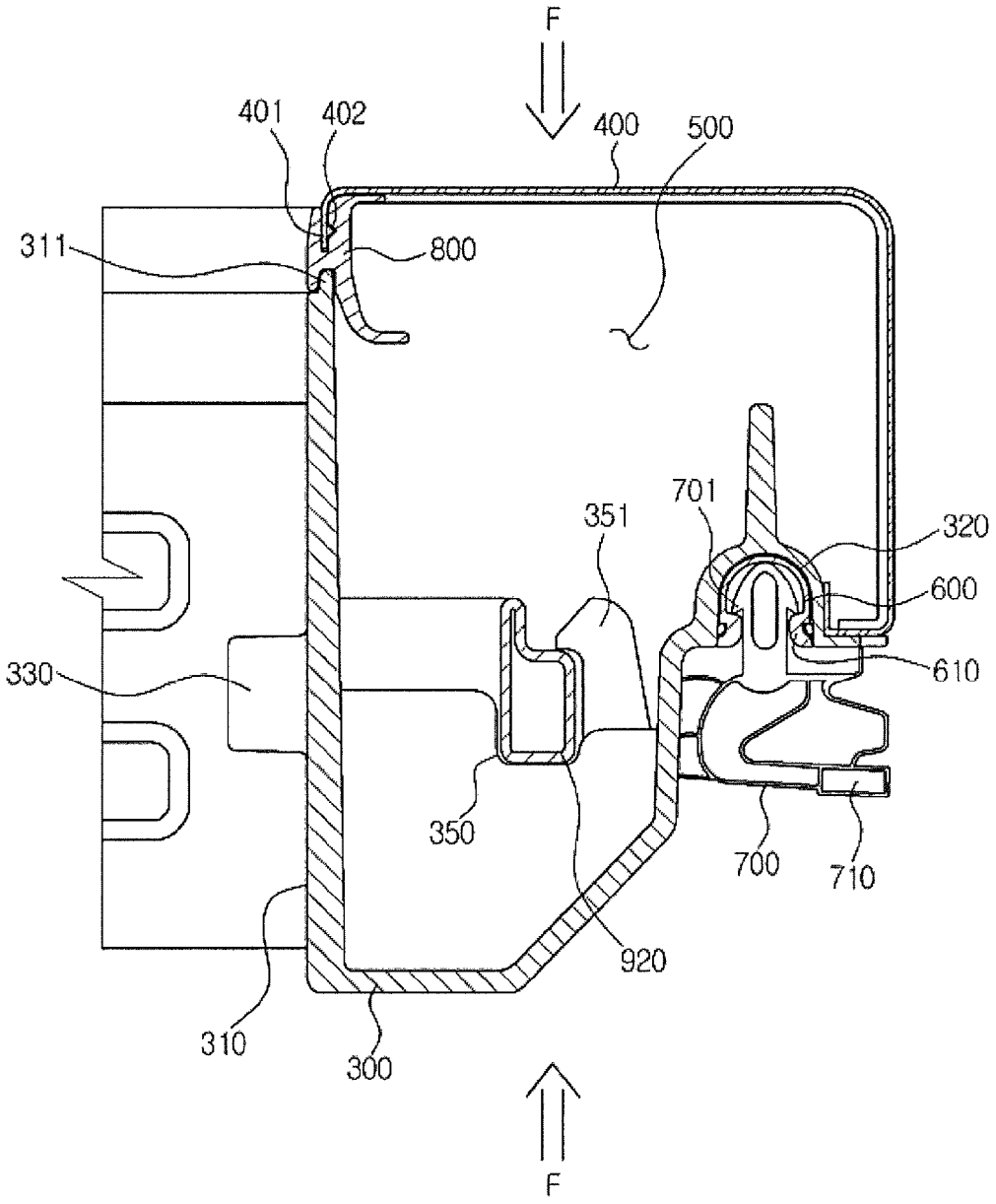
FIG. 11 is a cross-sectional view of a portion of the inner door of the refrigerator of FIG. 1.
Figure 12:
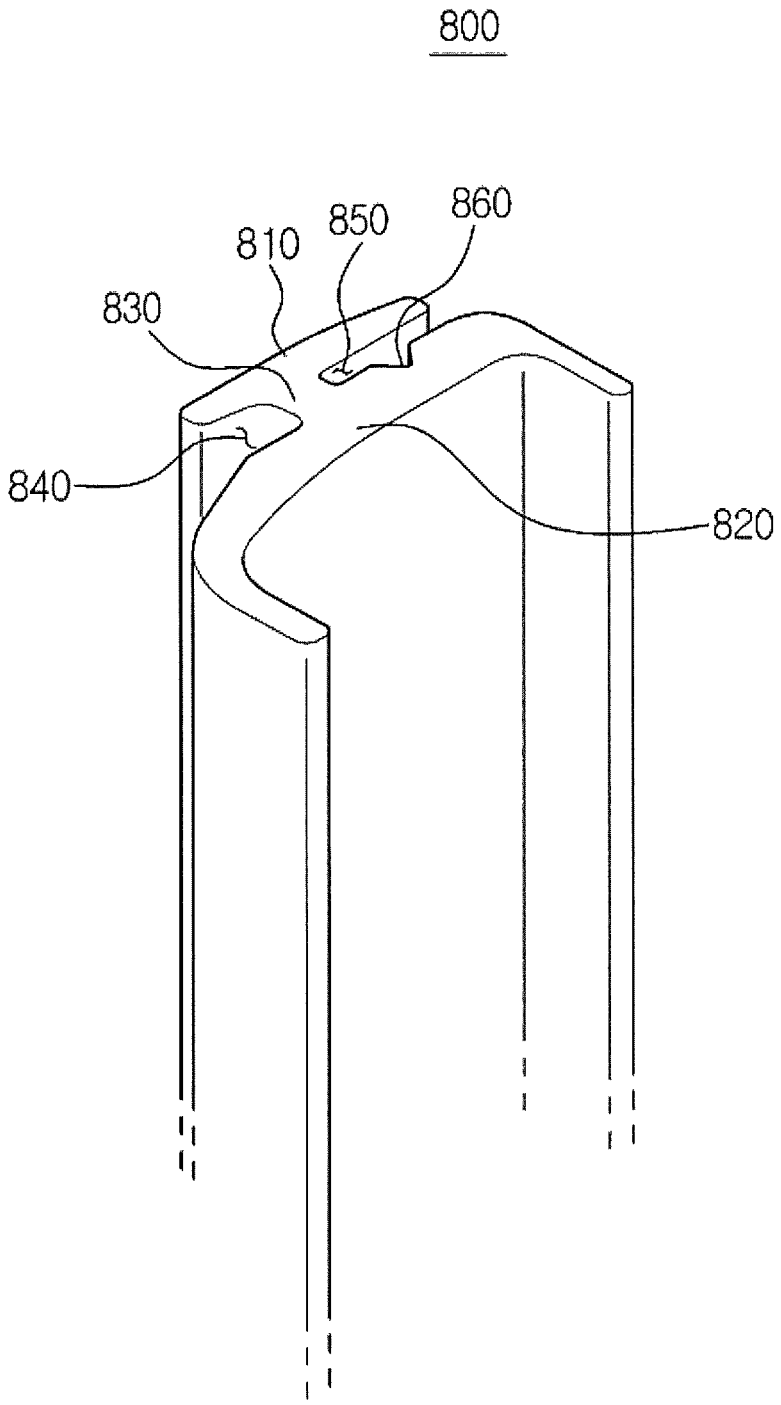
FIG. 12 is a drawing illustrating a door trim of the refrigerator of FIG. 1.

FIG. 5 is a drawing illustrating the door guards and the inner door of the refrigerator of FIG. 1, FIG. 6 is a cross-sectional view of the inner door and the outer door of the refrigerator of FIG. 1, FIG. 7 is a cross-sectional view illustrating a state of the door guards mounted at the inner door of the refrigerator of FIG. 1, FIG. 8 is an exploded view illustrating a exploded structure of the inner door of the refrigerator of FIG. 1, FIG. 9 is a drawing illustrating a portion of an inner panel of the inner door of the refrigerator of FIG. 1, FIG. 10 is a cross-sectional view illustrating a state of an installation member accommodated at the inner panel of the inner door of the refrigerator of FIG. 1, FIG. 11 is a cross-sectional view of a portion of the inner door of the refrigerator of FIG. 1, and FIG. 12 is a drawing illustrating a door trim of the refrigerator of FIG. 1.

As illustrated in FIG. 5, the door guards 40 each may be provided with an approximately box shape. Thus, the door guards 40 each may be provided with a front wall 41, a rear wall 42, a left side wall 43, a right side wall 44, a bottom wall 45, and a storage space 46 at which food is stored. At each of the left wall 43 and the right side wall 44 of the door guard 40, a supporting groove 47 may be formed.

The inner door 200 includes inner side walls 310 provided at both sides of the opening 210 to support the door guards 40, and at the inner side walls 310, supporting protrusions 330 being inserted into the supporting grooves 47 of the door guards 40 may be protruded.

Thus, as the supporting protrusions 330 are inserted into the supporting grooves 47, the door guards 40 may be able to be mounted at the opening 210. The door guards 40 as such may be detached from the opening 21, and although not illustrated, the door guards 40 may be provided in a way to be moved forward/backward directions or upward/downward directions in a sliding manner.

Meanwhile, as illustrated on FIG. 8, the inner door 200 includes an inner panel 300, an outer panel 400 coupled to the inner panel 300 and provided with a foaming space 500 (FIG. 6) formed in between the inner panel 300 and the outer panel 400, a plurality of installation member 600 coupled to a rear surface of the inner panel 300 and at which a gasket 700 (FIG. 6) is installed, a plurality of reinforcing members 910 and 920 to prevent a twist of the inner door 200, and a door trim 800 coupled in between an end portion of the inner panel 300 and an end portion of the outer panel 300 to prevent a foaming agent being blown into the foaming space 500 from being leaked to an outside.

The inner panel 300 includes an upper frame 301, a lower frame 302, a left side frame 303, and a right side frame 304, and may be injection-molded by use of resin as an integrated form. The outer panel 400 may be formed of metal.

As illustrated on FIG. 6, the inner panel 300 includes a pair of inner side walls 310 provided at both sides of the opening 210. The inner side walls 310 may be able to support the door guards 40 (FIG. 7) at the same time of forming the opening 210.

At this time, the inner side walls 310 each is formed in a plane manner without being crooked from an entry 211 of the opening 210 to an exit 212 of the opening 210. In addition, the distance D in between the pair of inner side walls 310 may be constant from the entry 211 of the opening 210 to the exit 212 of the opening 210.

As the above, the inner side wall 310 each is formed in a plane manner to maximize the size of the opening 210, and in order to form the inner side walls 310 in a plane manner, the inner panel 300 may be formed through an injection molding instead of through a vacuum molding.

The vacuum molding is a method configured to perform a molding by intaking air in between a resin sheet and a mold such that the sheet comes into a close contact with the mold, and is less expensive than the injection molding method and also convenient to mold, but since the sheet is needed to come into close contact with the molding, a plane surface perpendicular to the mold may be difficult to form.

Meanwhile, as illustrated on FIG. 7, the door guards 40 may be disposed in a way to make contact with the entry 211 of the opening 210 in a approximate manner such that the front wall 41 of the door guard 40 forms a portion of a front surface of the inner door 200, and the front wall 41 of the door guard 40 may be entirely exposed without being covered by the inner door 200.

With the structure as such, the door guards 40 take the entire area of the opening 210, and thus the sizes of the door guards 40 may be able to be maximized. In addition, when the door guards 40 are viewed from an outside the inner door 200, the door guards 40 are entirely exposed, and thus the status of the food stored at the door guards 40 may be easily ascertained.

Meanwhile, the door guards 40 of the refrigerator in accordance with an embodiment of the present disclosure are disposed at the opening 210 of the inner door 200, other than a rear surface of the outer door 100.

The outer door 100 may include an outer door inner panel 130, an outer door outer panel 120, an insulation material 140 provided in between the outer door inner panel 130 and the outer door outer panel 120, and a gasket 110.

The outer door inner panel 130 may be vacuum-molded by use of resin, and the outer door outer panel 120 may be formed of metallic. The gasket 110 includes a magnet 111, and the magnet 111 may interact with the outer panel 400 of the inner door 200 formed of metallic material.

Meanwhile, the plurality of installation members 600 are configured to allow the gasket 700 to be installed at the inner panel 300 while minimizing the use of complex mold such as a slide core at the time of injection-molding the inner panel 300, and the plurality of installation members 600 are coupled to a rim of the rear surface of the inner panel 300.

As illustrated on FIG. 8, the plurality of installation members 600 may include a first installation member 601 coupled to the upper frame 301 of the inner panel 300, a second installation member 602 coupled to the lower frame 302 of the inner panel 300, a third installation member 603 coupled to the left side frame 303 of the inner panel 300, and a fourth installation member 604 coupled to the right side frame 304 of the inner panel 300.

For reference, on the present disclosure and the drawings, in a case when the first installation member 601, the second installation member 602, the third installation member 603, and the fourth installation member 604 are not needed to be particularly distinguished, the first installation member 601, the second installation member 602, the third installation member 603, and the fourth installation member 604 are commonly referred to as the installation member 600.

At this time, the first installation member 601, the second installation member 602, the third installation member 603, and the fourth installation member 604 are not connected to one another, and may be provided in a way to be spaced apart by a predetermined gap G. Thus, the first installation member 601, the second installation member 602, the third installation member 603, and the fourth installation member 604 may be prevented from being interfered with one another by thermal expansion.

Meanwhile, as illustrated on FIG. 9 and FIG. 10, at the rim of the rear surface of the inner panel 300, an accommodation groove 320 at which the installation member 600 is accommodated may be formed. At this time, the accommodation groove 320 may have a cross section increasing from a deepest position 322 to a shallowest position 323. That is, the accommodation groove 320 may be formed through a general mold instead of a complex mold such as a slide core.

However, accommodation protrusions 321 are provided in the least number required to fix the installation member 600 while protruding toward the accommodation groove 320. Thus, the plurality of accommodation protrusions 321 are not formed at the entire area of the accommodation groove 320, but formed only on a portion of the accommodation groove 320. The plurality of accommodation protrusions 321 may be formed while being spaced apart from one another.

The installation member 600 includes an installation groove 620 at which the gasket 700 (FIG. 11) is installed, an installation protrusion 630 protruded toward an inner side of the installation groove 620 to fix the gasket 700 including magnet 710, and an insertion groove 610 into which the accommodation protrusion 321 of the inner panel 300 is inserted.

The installation protrusion 630 is interfered with a fixing protrusion 701 (FIG. 11) of the gasket 700, thereby is able to fix the gasket 700. The installation groove 620 and the installation protrusion 630 of the installation member 600 may be easily formed in an integrated manner through an extrusion molding.

Thus, the refrigerator 1 in accordance with an embodiment of the present disclosure, by inserting the installation member 600 into the accommodation groove 320 formed at the inner panel 300 of the inner door 200 and by inserting the gasket 700 into the installation groove 620 formed at the installation member 600, the gasket 700 may be able to be installed at the inner panel 300 as a result, and through the process as the above, the inner panel 300 may be injection-molded by use of a simple mold, while the installation member 600 may be extrusion-molded.

Meanwhile, the door trim 800 is configured to prevent a foaming agent at the foaming space 500 in between the inner panel 300 and the outer panel 400 from being leaked to an outside, and as illustrated on FIG. 11 and FIG. 12, the door trim 800 may include a first insertion groove 840, into which an end portion 311 of the inner side wall 310 of the inner panel 300 is closely inserted, and a second insertion groove 850, into which an end portion 401 of the outer panel 400 is closely inserted.

In addition, the door trim 800 may include a first supporting part 810 supporting the inner panel 300 and the outer panel 400 from an outer side, a second supporting part 820 supporting the inner panel 300 and the outer panel 400 from an inner side, and a connection part 830 connecting the first supporting part 810 to the second supporting part 820.

In addition, at the second supporting part 820, a coupling groove 860 into which a coupling protrusion 402 of the outer panel 400 is inserted may be formed, so that the coupling strength of the door trim 800 and the outer panel 400 may be strengthened.

The foaming process of the inner door 300 having the door trim 800 is as follows.

First, after preliminarily coupling the inner panel 300, the outer panel 400 and the door trim 800, and then placing the inner panel 300 to face toward a bottom surface while the outer panel 400 is placed to face upward, the inner panel 300 and the outer panel 400 are pressed in an upper and lower direction F using a fixed jig (not shown).

Next, a foaming agent is injected into the foaming space 500 formed in between the inner panel 300 and the outer panel 400 and blown. At this time, since the inner panel 300 and the outer panel 400 are being pressed in the upper and lower direction, a gap between the inner panel 300 and the outer panel 400 is prevented from opening due to the foaming pressure in the upper and lower direction, and thus preventing the foaming agent from leaking in the upper and lower direction.

In addition, since the end portion 311 of the inner panel 300 and the end portion 402 of the outer panel 400 are firmly grasped by the door trim 800, a gap between the inner panel 300 and the outer panel 400 is prevented from opening due to the foaming pressure of a left and right direction, and thus the foaming agent is not leaked.

In a case when the door trim 800 is not present, and even when the inner panel 300 and the outer panel 400 at the opening are provided to overlap each other, the gap between the inner panel 300 and the outer panel 400 may be open by the foaming pressure, and the foaming agent may leak.

As the foaming agent completely blown in the foaming space 500, the adhesiveness of the foaming agent allows the outer panel 400 and the door trim 800 to be solidly coupled to each other.

Meanwhile, the inner door 200 of the refrigerator 1 in accordance with an aspect of the present disclosure is provided with the opening 210, and thus the inner door 200 is vulnerable to twist. In addition, during a foaming process of the inner door 200, a twist may occur or the inner side wall 310 may not be evenly formed by the foaming pressure. To compensate the difficulty as such, at the inner door 200, the plurality of reinforcing members 910 and 920 may be provided.

The plurality of reinforcing members 910 and 920 may include a first reinforcing member 910 connecting the left side frame 303 of the inner panel 300 to the right side frame 304 of the inner panel 300 while crossing over the opening 210, and a second reinforcing member 920 provided at the upper frame 301 of the inner panel 300, the lower frame 302 of the inner panel 300, the left side frame 303 of the inner panel 300, and the right side frame 304 of the inner panel 300.

With respect to the structure of the second reinforcing member 920, while the description with regard to the first reinforcing member 910 will be provided later, the second reinforcing member 920 may include an upper reinforcing part 921, a lower reinforcing part 922, a left side reinforcing part 923, and a right side reinforcing part 924, and may be provided with the shape of an approximate rectangular frame shape. The second reinforcing member 920 may be integrally formed of metallic having rigidity.

As illustrated on FIG. 11, at the inner panel 300, an accommodating space 350 in which the second reinforcing member 920 is accommodated, and a hook part 351 to fix the second reinforcing member 920 may be formed. Thus, the second reinforcing member 920 is coupled to the inner panel 300, and may be disposed in between the inner panel 300 and the outer panel 400. Thus, the second reinforcing member 920 may not be exposed to an outside.

The second reinforcing member 920 may be fixed to the inner panel 300 prior to the foaming agent is foamed in the foaming space 500 between the inner panel 300 and the outer panel 400.

Figure 13:
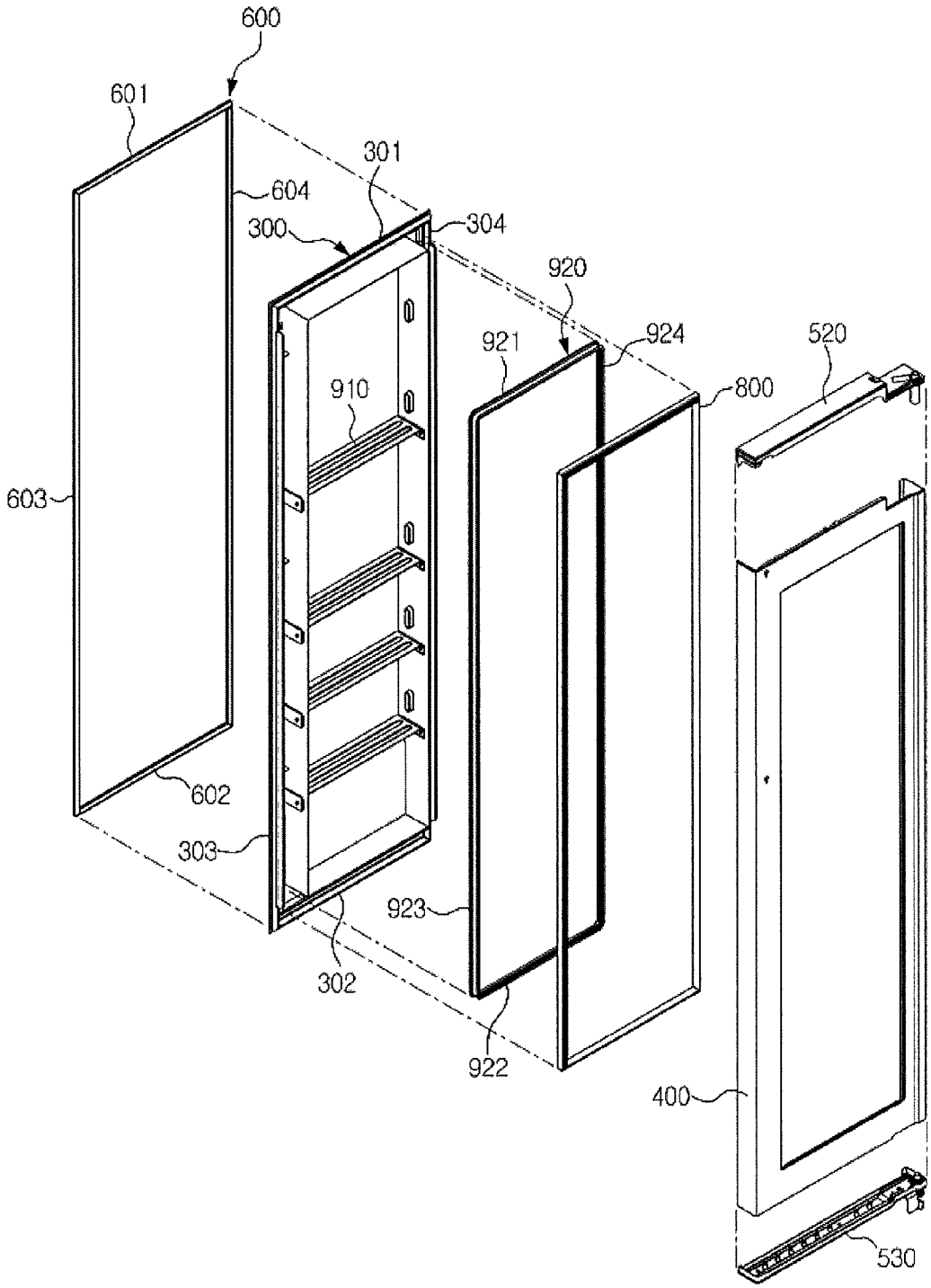
FIG. 13 is an exploded perspective view from a different angle illustrating an exploded structure of the inner door of the refrigerator of FIG. 1.
Figure 14:
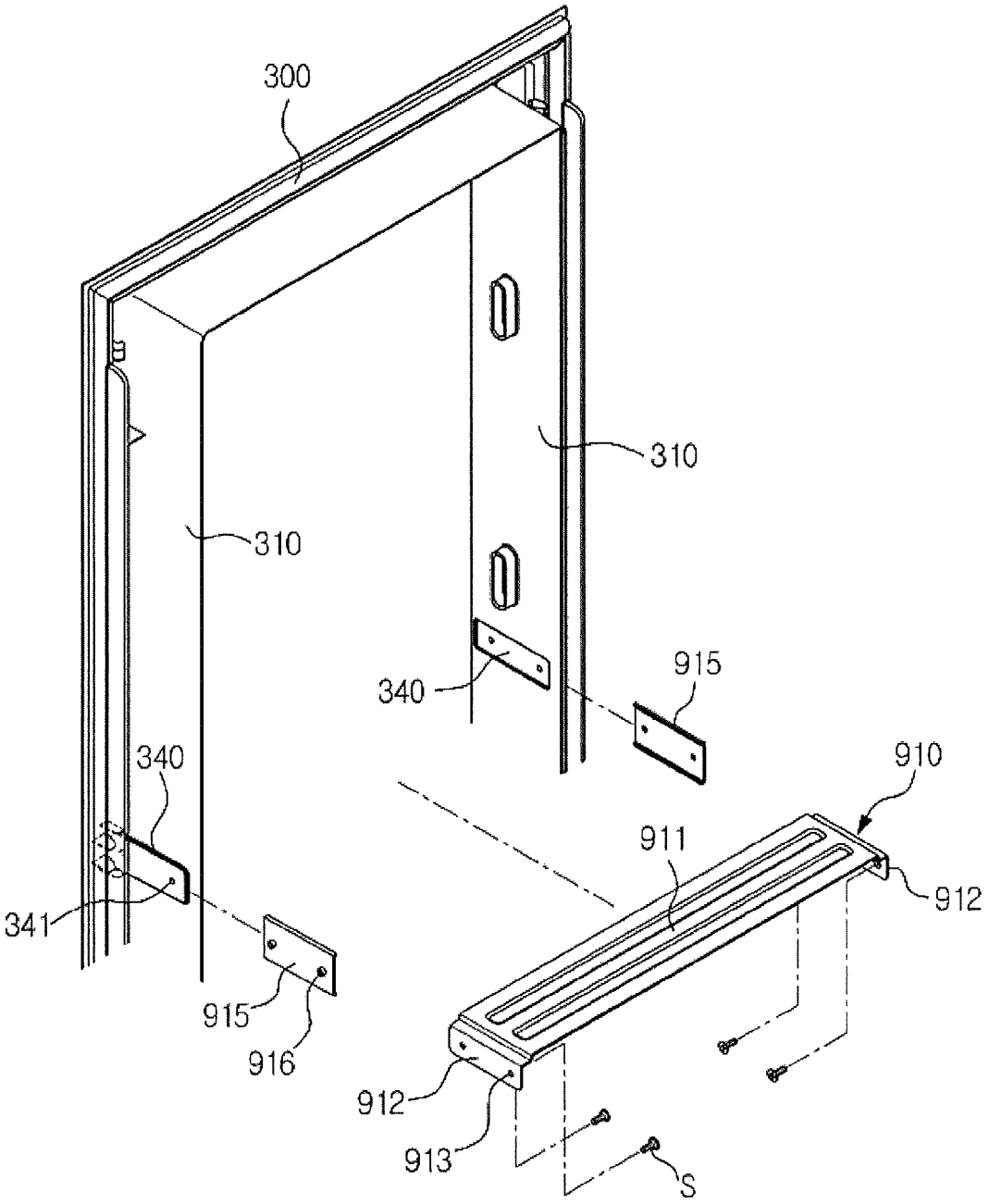
FIG. 14 is an exploded perspective view illustrating a coupling structure of a first reinforcing member of the refrigerator of FIG. 1.
Figure 15:
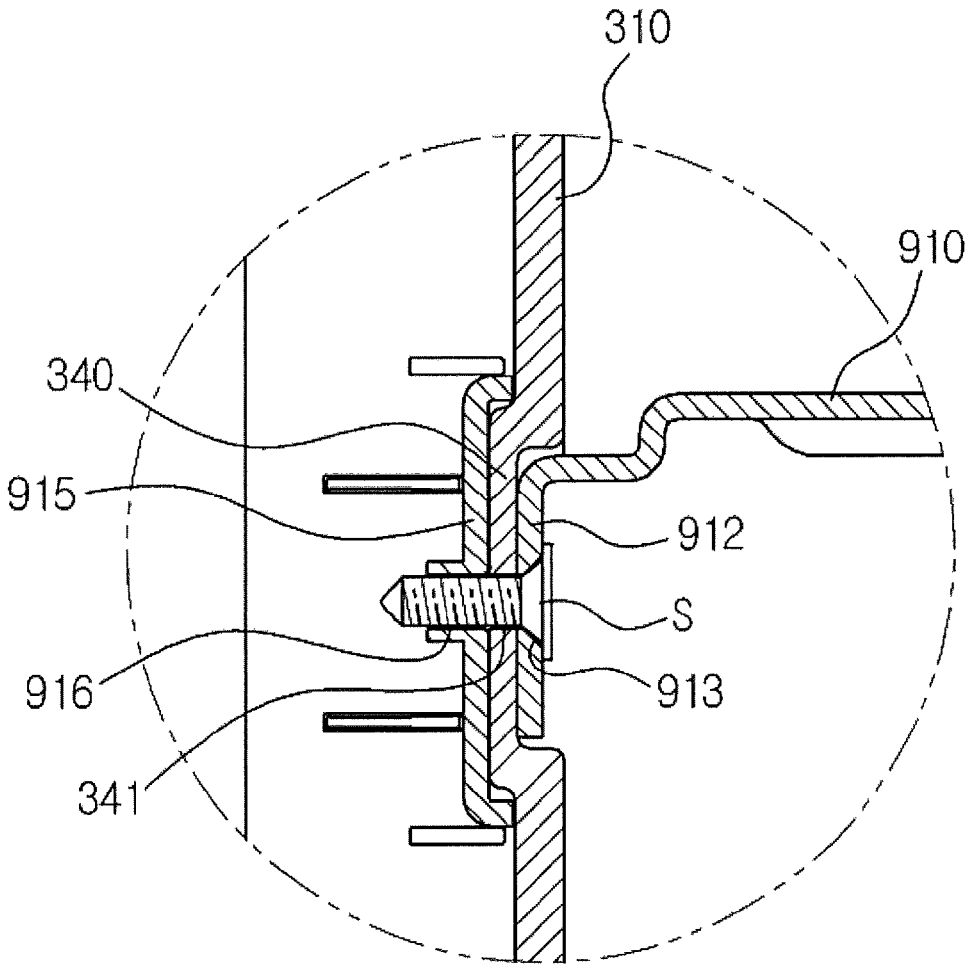
FIG. 15 is a cross-sectional view illustrating the coupling structure of the first reinforcing member of the refrigerator of FIG. 1.

FIG. 13 is an exploded view from a different angle illustrating an exploded structure of the inner door of the refrigerator of FIG. 1, FIG. 14 is an exploded view illustrating a coupling structure of the first reinforcing member of the refrigerator of FIG. 1, and FIG. 15 is a cross-sectional view illustrating a coupling structure of the first reinforcing member of the refrigerator of FIG. 1.

Referring to FIGS. 13 to 15, the first reinforcing member 910 may be coupled to the inner side wall 310 of the inner panel 300 through a fastening member S. The fastening member S may be a screw. At the inner side wall 310, a depression part 340 to which the first reinforcing member 910 is coupled may be formed.

The first reinforcing member 910 may include a connection part 911 crossing over the opening 210, and a pair of coupling parts 912 bent from both end portions of the connection part 911 and coming into close contact with the depression part 340.

At the coupling part 912, a fastening hole 913 allowing the fastening member S to pass therethrough is formed, and at the depression part 340 of the inner side wall 310, a fastening hole 341 allowing the fastening member S to pass therethrough may be formed.

In addition, as to reinforce the fastening force by the fastening member S, a cover panel 915 may be coupled to an opposite side to the first reinforcing member 910 with respect to the inner side wall 310. At the cover panel 915, a fastening hole 916 allowing the fastening member S to pass therethrough may be formed. Thus, the fastening member S may sequentially pass through the first reinforcing member 910, the inner side wall 310, and the cover panel 915.

As discussed above, the first reinforcing member 910 is configured to prevent the twisting of the inner door 200 by directly connecting the left side frame 303 of the inner panel 300 and the right side frame 304 of the inner panel 300, which have relatively long lengths, to each other while crossing over the opening 210, and the second reinforcing member 920 is provided at the upper frame 301 of the inner panel 300, the lower frame 302 of the inner panel 300, the left side frame 303 of the inner panel 300, and the right side frame 304 of the inner panel 300 to reinforcing four surfaces, thereby preventing the twisting of the inner door 200.

However, in the embodiment of the present disclosure, both the first reinforcing member 910 and the second reinforcing member 920 are provided, but if needed, only one of the first reinforcing member 910 and the second reinforcing member 920 may be provided.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment formed at an inside of the body;

an inner door having an opening corresponding to the storage compartment, and a door frame forming the opening, the inner door being rotatably coupled to the body;

a plurality of door guards provided at the opening; and an outer door to open/close the opening, wherein the inner door comprises an inner panel, an outer panel, an insulation material disposed in between the inner panel and the outer panel, an installation member coupled to the inner panel, and a gasket installed at the installation member to seal in between the body and the inner panel, wherein the inner panel comprises an accommodation groove to accommodate the installation member, wherein the inner panel comprises a plurality of accommodation protrusions formed in the accommodation groove to fix the installation member, wherein the plurality of accommodation protrusions comprise a plurality of pairs of accommodation protrusions protruding toward both sides of the installation member, and wherein the plurality of pairs of accommodation protrusions are spaced apart from each other.

2. The refrigerator of claim 1, wherein:

the inner panel comprises a pair of inner side walls configured to form the opening and support the door guards, and the inner side walls are formed to be flat from an entry of the opening to an exit of the opening, and a distance between the pair of inner side walls is constant from the entry of the opening to the exit of the opening.

3. The refrigerator of claim 1, wherein:

the inner panel comprises a plurality of accommodation protrusions protruding toward an inner side of the accommodation groove to fix the installation member.

4. The refrigerator of claim 3, wherein:

the plurality of accommodation protrusions are formed at a portion of the accommodation groove while being spaced apart from one another.

5. The refrigerator of claim 3, wherein:

the installation member comprises insertion grooves into which the accommodation protrusions are inserted.

6. The refrigerator of claim 1, wherein:

the inner panel is injection-molded by use of resin.

7. The refrigerator of claim 1, wherein:

the installation member comprises an installation groove at which the gasket is installed, and installation protrusions protruding toward an inner side of the installation groove to fix the gasket.

8. The refrigerator of claim 7, wherein:

the installation protrusions is successively formed at an entire area of the installation groove lengthwise along the installation member.

9. The refrigerator of claim 1, wherein:

the installation member is extrusion-molded.

10. The refrigerator of claim 1, wherein:

the inner panel comprises an upper frame, a lower frame, a left frame, and a right frame, and the first installation member, second installation member, third installation member and fourth installation member are installed at the upper frame, the lower frame, the left frame, and the right frame, respectively.

11. The refrigerator of claim 1, wherein:

the outer panel is formed of metal, and the outer door comprises a gasket configured to seal in between the inner door and the outer door, and the gasket comprises a magnet.

12. A refrigerator, comprising:

a body;

a storage compartment formed at an inside the body;

an inner door having an opening corresponding to the storage compartment, an inner panel, an outer panel, and an insulation material disposed in between the inner panel and the outer panel, the inner door rotatably coupled to the body;

a gasket assembly to seal in between the inner door and the body;

a plurality of door guards provided at the opening; and an outer door rotatably coupled to the body to open and close the opening, wherein the inner panel comprises an accommodation groove formed at a rear surface of the inner panel so that the gasket assembly is coupled thereto, wherein the gasket assembly comprises an installation member accommodated in the accommodation groove, and a gasket installed at the installation member, wherein the installation member comprises a first installation member, a second installation member, a third installation member and a fourth installation member, and wherein the first, second, third and fourth installation members are spaced apart from one another.

13. The refrigerator of claim 12, wherein:

the inner panel comprises a pair of inner side walls configured to form the opening and support the door guards, and the inner side walls are formed to be flat from an entry of the opening to an exit of the opening, and a distance in between the pair of inner side walls is constant from the entry of the opening to the exit of the opening.

14. The refrigerator of claim 12, wherein:

the inner panel is injection-molded by use of resin.

15. A method of manufacturing a refrigerator, having a body, a storage compartment formed at an inside the body, an inner door having an opening corresponding to the storage compartment and rotatably coupled to the body, a plurality of door guards provided at the opening, and an outer door rotatably coupled to the body to open/close the opening, the method comprising:

injection-molding an inner panel having an accommodation groove to accommodate an installation member;

inserting the installation member into the accommodation groove; and installing a gasket at the installation member, wherein the installation member comprises a first installation member, a second installation member, a third installation member and a fourth installation member, and wherein the first, second, third and fourth installation members are spaced apart from one another.

16. The method of claim 15, wherein injection molding the inner panel comprises forming a pair of inner side walls configured to form the opening and support the door guards.

17. The method of claim 16, wherein forming the pair of inner side walls comprises forming the inner side walls to be flat from an entry of the opening to an exit of the opening.

18. The method of claim 17, wherein a distance in between the pair of inner side walls is constant from the entry of the opening to the exit of the opening.

19. The method of claim 15, wherein installing the gasket comprises receiving the gasket in an installation groove in the installation member, and fixing the gasket with an installation protrusion protruding inward of the installation groove.

* * * * *